US007677238B2

(12) United States Patent
Hancock

(10) Patent No.: US 7,677,238 B2
(45) **Date of Patent: *Mar. 16, 2010**

(54) FURNACE WITH INTEGRATED BLOWER HOUSING AND HEAT EXCHANGER

(75) Inventor: Stephen S. Hancock, Flint, TX (US)

(73) Assignee: Trane International Inc., Piscataway, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/147,359

(22) Filed: Jun. 26, 2008

(65) Prior Publication Data

US 2008/0257336 A1 Oct. 23, 2008

Related U.S. Application Data

(63) Continuation-in-part of application No. 11/732,469, filed on Apr. 3, 2007.

(51) Int. Cl.
*F28F 13/12* (2006.01)

(52) U.S. Cl. ..... 126/116 R; 126/99 R; 126/110 R; 126/122; 165/47; 165/125; 165/122; 415/170; 415/175

(58) Field of Classification Search ..... 126/116 R, 126/99 R, 110 R; 165/47, 125, 122; 415/204, 415/205

See application file for complete search history.

(56) References Cited

U.S. PATENT DOCUMENTS

| | | | |
|---|---|---|---|
| 405,849 | A | 6/1889 | Rinehart |
| 1,421,221 | A | 6/1922 | Harter |
| 1,884,898 | A | 10/1932 | Smith, Jr. |
| 2,053,036 | A | 9/1936 | Jones |
| 2,368,392 | A | 1/1945 | Young |
| 2,556,170 | A | 6/1951 | Davidson |
| 2,588,352 | A | 3/1952 | Budlane |
| 2,673,074 | A | 3/1954 | Dailey |
| 2,856,162 | A | 10/1958 | Adams |
| 3,140,706 | A | 7/1964 | Block et al. |
| 3,211,891 | A | 10/1965 | Kendall |
| 4,313,493 | A | 2/1982 | Kawase et al. |

(Continued)

FOREIGN PATENT DOCUMENTS

| | | |
|---|---|---|
| GB | 268313 | 3/1927 |

OTHER PUBLICATIONS

Hancock, Stephen; U.S. Appl. No. 11/732,469; Title: "Furnace with Integrated Blower Housing and Heat Exchanger"; Filing Date: Apr. 3, 2007; Specification 15 pages; 6 Drawing Sheets (Figs. 1-7).

*Primary Examiner*—Steven B McAllister
*Assistant Examiner*—Nikhil Mashruwala
(74) *Attorney, Agent, or Firm*—Conley Rose, P.C.; Shannon W. Bates

(57) ABSTRACT

A combustion furnace includes a blower housing with a centrifugal blower impeller disposed therein and plural heat exchanger tubes disposed substantially around a major portion of the periphery of the impeller. The heat exchanger tubes receive combustion gasses from plural burner nozzles and discharge combustion gasses to a plenum in communication with a motor driven inducer gas pump. The integrated blower housing and heat exchanger may be disposed in a cabinet including support structure for a fuel delivery manifold, associated burner nozzles and forming air inlet and outlet openings for air being circulated by the blower.

24 Claims, 7 Drawing Sheets

U.S. PATENT DOCUMENTS 4,526,510 A 7/1985 Hoffman et al.
5,060,722 A 10/1991 Zdenek et al.
5,368,010 A * 11/1994 Weber et al. ..... 126/110 R
5,445,218 A 8/1995 Nieh
5,546,925 A * 8/1996 Knight et al. ..... 126/110 R
6,692,223 B2 2/2004 Ikeda et al.
6,698,506 B1 * 3/2004 Barrett ..... 165/122
2003/0077169 A1 4/2003 Rosenthal et al.

* cited by examiner

FURNACE WITH INTEGRATED BLOWER HOUSING AND HEAT EXCHANGER

CROSS-REFERENCE TO RELATED APPLICATIONS

This is a continuation-in-part application of co-pending U.S. application Ser. No. 11/732,469 filed Apr. 3, 2007, by Stephen S. Hancock, et al. and entitled "Furnace With Integrated Blower Housing and Heat Exchanger", which is incorporated herein by reference for all purposes.

BACKGROUND OF THE INVENTION

In the development of heating equipment, including combustion furnaces, particularly for use in heating enclosed spaces, there has been a continuing need to provide a heater which is compact, economical to manufacture and energy efficient. Conventional combustion furnace type heaters, for example, include separate heat exchanger and blower or fan housing structures which are disposed within a generally rectangular box-like cabinet having an air inlet opening for so-called return air and an air outlet opening for so-called supply air. However, the requirements mentioned above with respect to overall physical size of the heater or furnace, the cost of manufacture and energy efficiency continue to be motivating factors for further developments and it is to these ends that the present invention has been developed.

SUMMARY OF THE INVENTION

The present invention provides an improved heater for forced air heating of enclosed spaces wherein a heat exchanger is integrated with a housing for a motor driven rotating fan or blower. In particular, the invention is directed to a compact forced air furnace for heating air deliverable to an enclosed space and wherein a combustion heat exchanger is integrated into a centrifugal blower housing.

In accordance with one important aspect of the present invention, an integrated heat exchanger and blower housing is provided comprising a compact combustion furnace wherein multiple heat exchanger tubes are disposed within a generally spiral or scroll-type housing for a centrifugal blower wheel or impeller. Multiple side-by-side heat exchanger tubes substantially encircle a centrifugal blower impeller disposed within a blower housing. In this way a heat exchanger is provided which is integral with the forced air blower structure and the blower housing forms an integral part of the heat exchanger as well as performing a conventional function of directing air to and from a centrifugal air moving impeller.

In accordance with another aspect of the present invention, a compact combustion furnace is provided which includes a blower housing including an integrated heat exchanger surrounding a centrifugal impeller or fan which is connected to a motor mounted on the blower housing. Plural side-by-side heat exchanger tubes are oriented to be in proximity to spaced apart burner nozzles, preferably mounted outside of the blower housing. The heat exchanger tubes substantially encircle the centrifugal blower impeller and are oriented to discharge combustion gasses into a plenum for evacuation from the furnace, which evacuation may be induced by a motor driven blower. Plural elongated burner tubes are oriented to include portions disposed downstream in the direction of air flow being impelled radially, outwardly and circumferentially with respect to the rotating centrifugal impeller. The configuration of the heat exchanger tubes with respect to cross sectional shape may be varied to minimize resistance to flow of air which is being heated through contact with the multiple heat exchanger tubes.

In accordance with yet a further aspect of the present invention, a forced air combustion furnace is provided which includes a compact, generally rectangular outer cabinet, a centrifugal blower housing mounted within the cabinet and a combustion furnace heat exchanger integrated into and with the blower housing and comprising plural side-by-side heat exchanger tubes arranged to allow airflow over substantially the entire surfaces of each tube to provide maximum heat exchange between combustion gasses flowing within the tubes and air circulating over the exterior surfaces of the tubes and being impelled by a centrifugal blower.

In accordance with still a further aspect of the present invention, a forced air combustion furnace is provided which includes a generally rectangular outer cabinet, a centrifugal blower housing mounted within the cabinet and a combustion furnace heat exchanger integrated into and with the blower housing and comprising plural side-by-side heat exchanger tubes having generally elliptical cross sections and arranged to allow airflow over substantially the entire surfaces of each tube to provide maximum heat exchange between combustion gasses flowing within the tubes and air circulating over the exterior surfaces of the tubes and being impelled by a centrifugal blower.

Those skilled in the art will further appreciate the above-mentioned advantages and superior features of the invention together with other important aspects thereof upon reading the detailed description which follows in conjunction with the drawings.

DETAILED DESCRIPTION OF PREFERRED EMBODIMENT(S)

Figure 1:
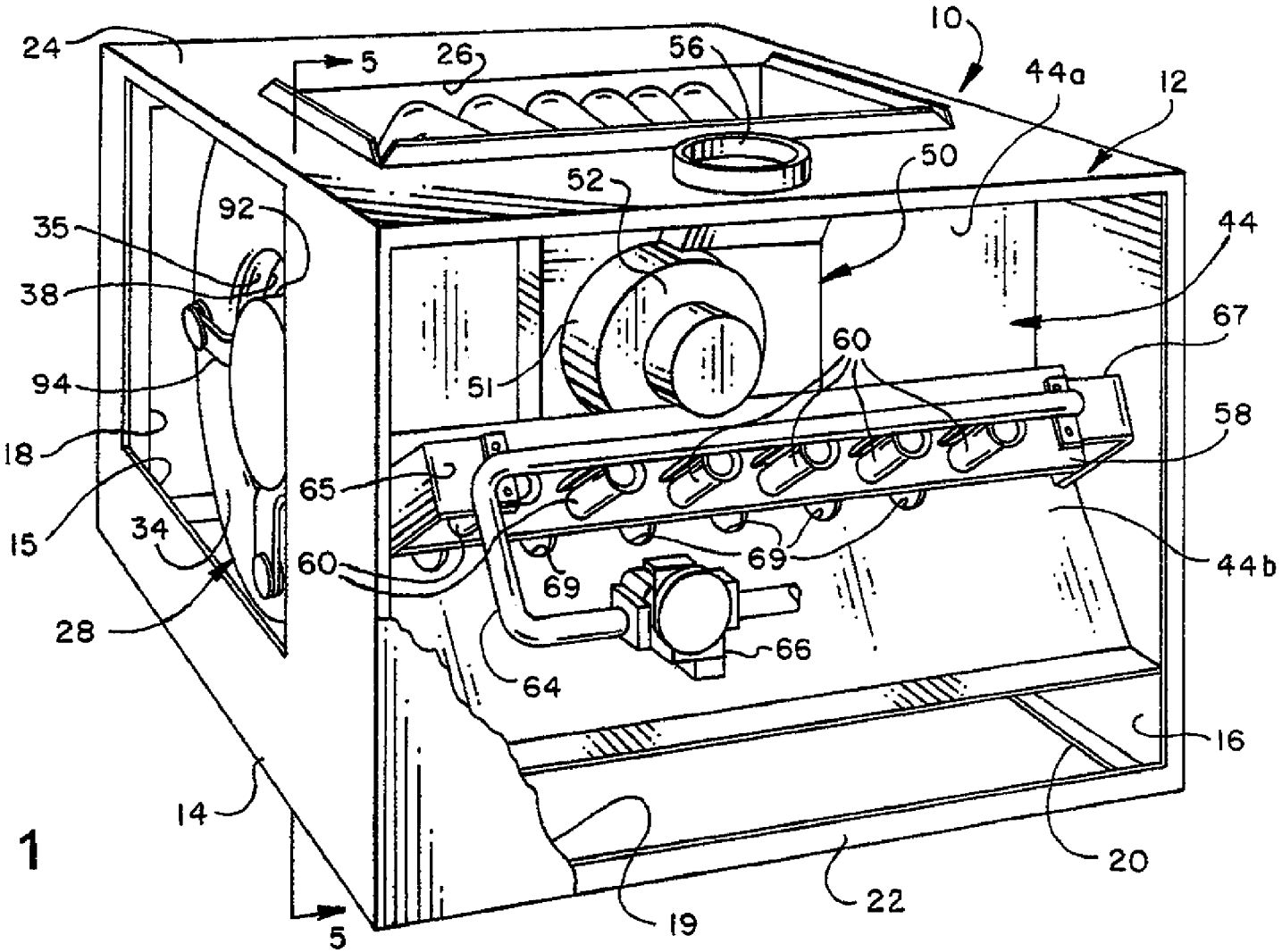
FIG. 1 is perspective view showing a heater comprising a combustion furnace with an integrated heat exchanger and forced air blower housing arrangement in accordance with the present invention.

In the description which follows, like parts are marked throughout the specification and drawing with the same reference numerals, respectively. The drawing figures may not be to scale and certain features may be shown exaggerated in scale or in somewhat generalized or schematic form in the interest of clarity and conciseness.

Figure 2:
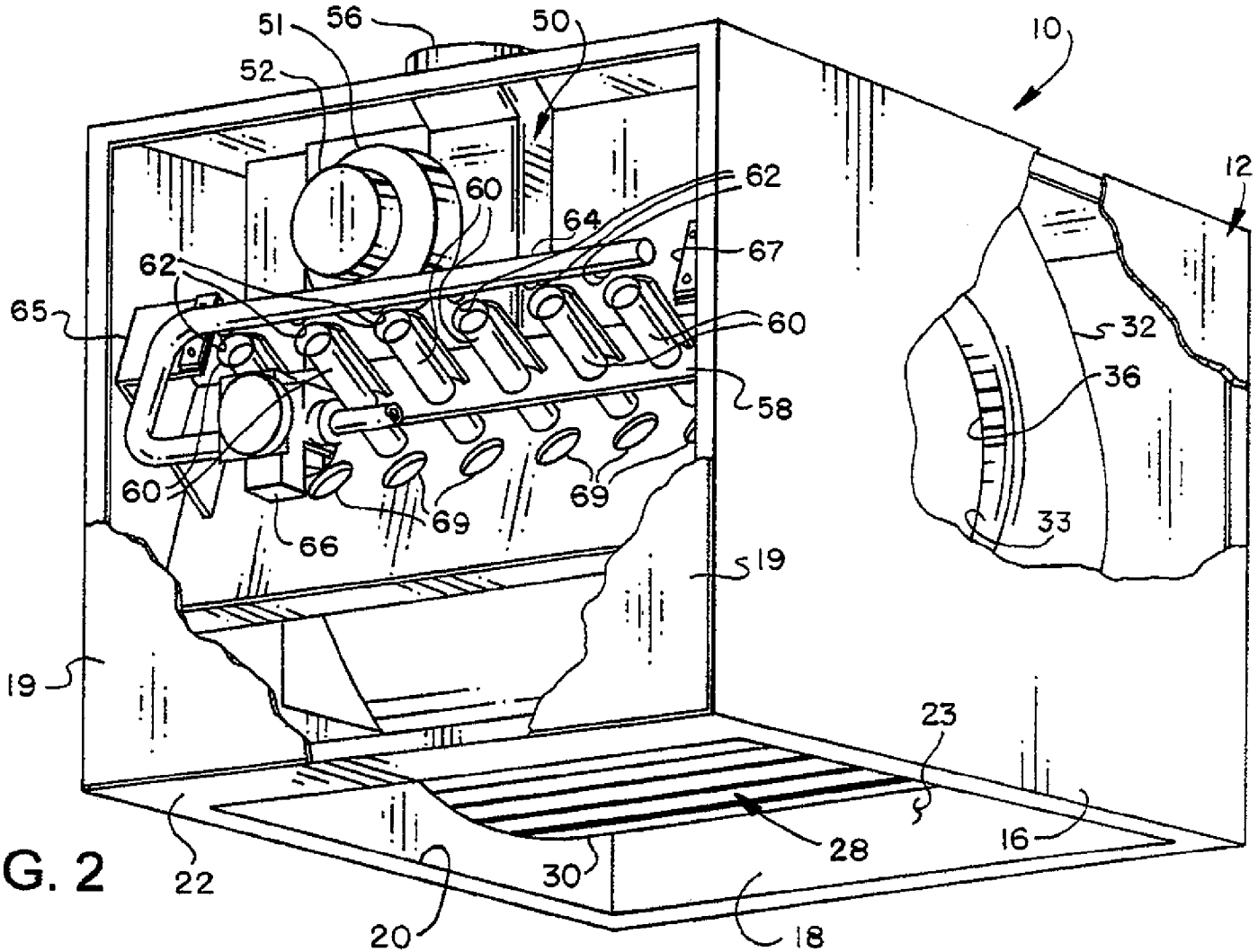
FIG. 2 is a perspective view of the furnace shown in FIG. 1 and taken from a different direction.

Referring to FIGS. 1 and 2, there is illustrated a heater for heating air for circulation within an enclosed space and generally designated by the numeral 10. The heater 10 in accordance with the invention is advantageously characterized as a combustion furnace and includes a generally rectangular cabinet 12 having opposed sidewalls 14 and 16, a backwall 18 and a removable front wall 19, a major portion of which is shown removed in the drawing figures. A relatively large air inlet opening 20 is defined by the opposed sidewalls 14 and 16, the backwall 18 and a cabinet frame member 22. A generally planar topwall 24, FIG. 1, has a suitable opening 26 formed therein for discharging air from the cabinet 12 for flow to a usage such as an enclosed space, not shown, within a residential or commercial building, for example. Air returning from the enclosed space enters the cabinet 12 through the inlet opening 20. Sidewall 14 may include a generally rectangular opening 15 normally covered by a service cover, not shown, so that by removing the service cover and blocking opening 20, return air may enter the cabinet interior space, generally designated by numeral 23, FIG. 2, via opening 15.

Figure 3:
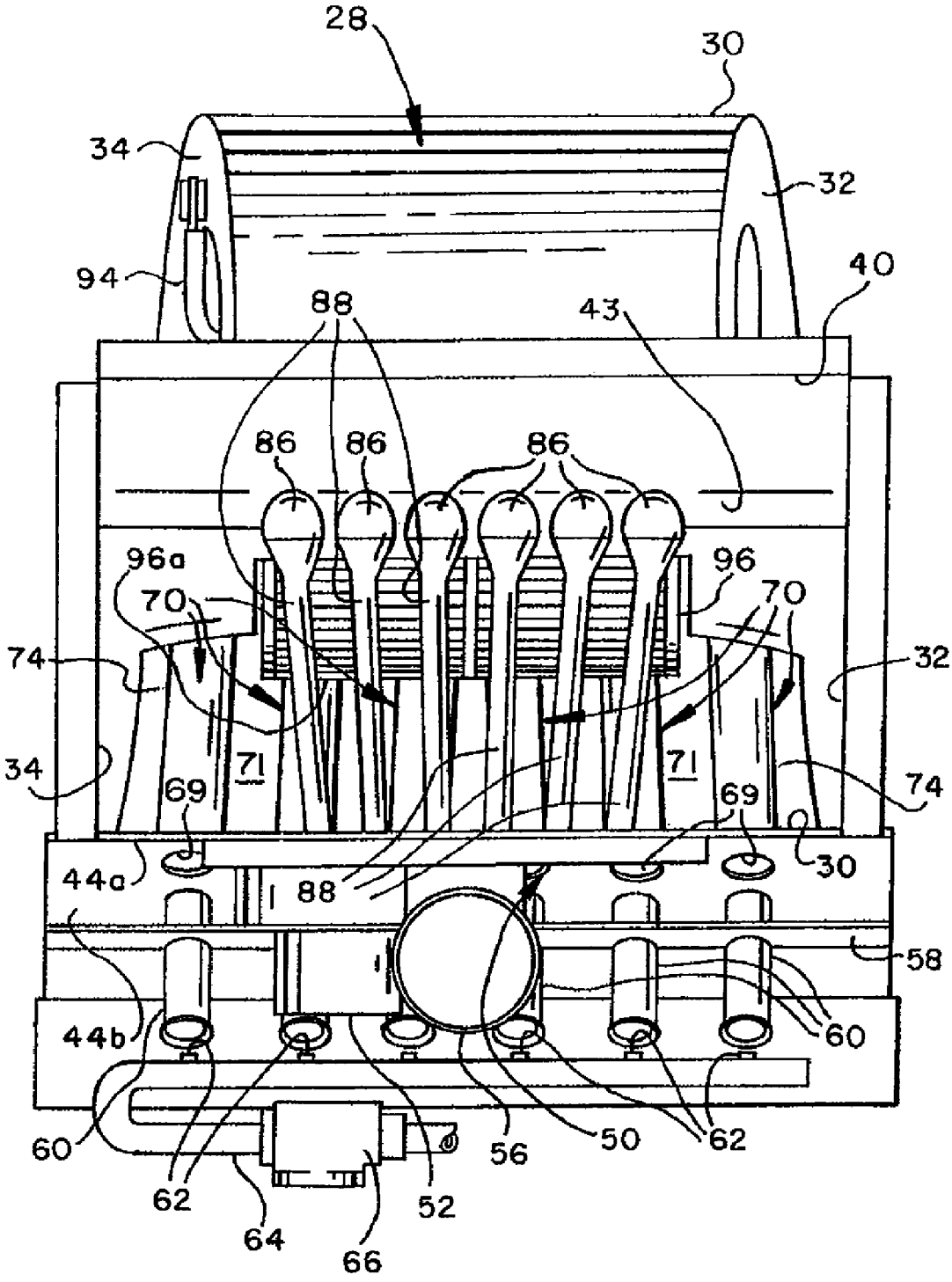
FIG. 3 is a top plan view of the furnace shown in FIGS. 1 and 2 with the outer cabinet removed.
Figure 5:
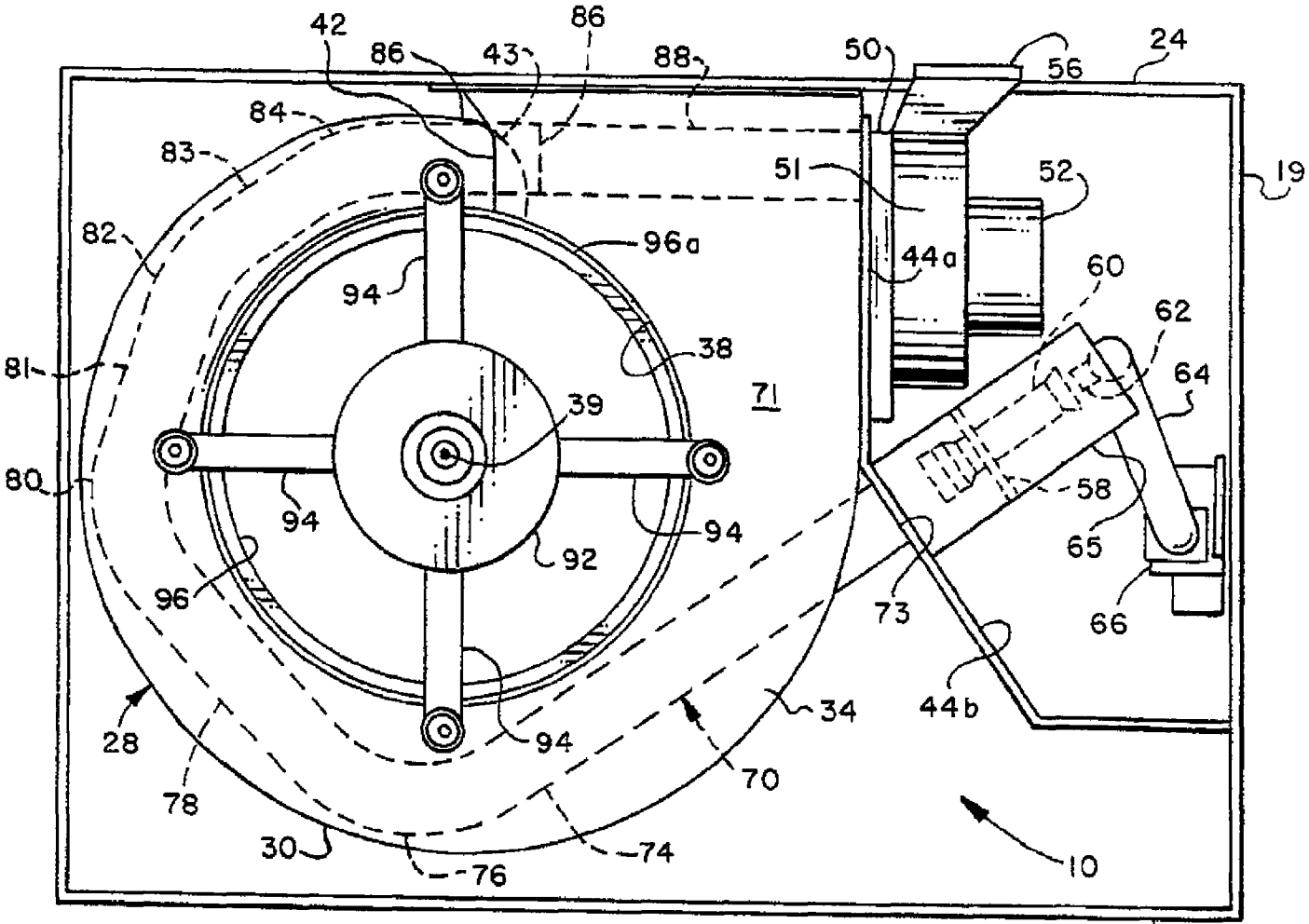
FIG. 5 is a transverse section view taken generally along the line 5-5 of FIG. 1.
Figure 6:
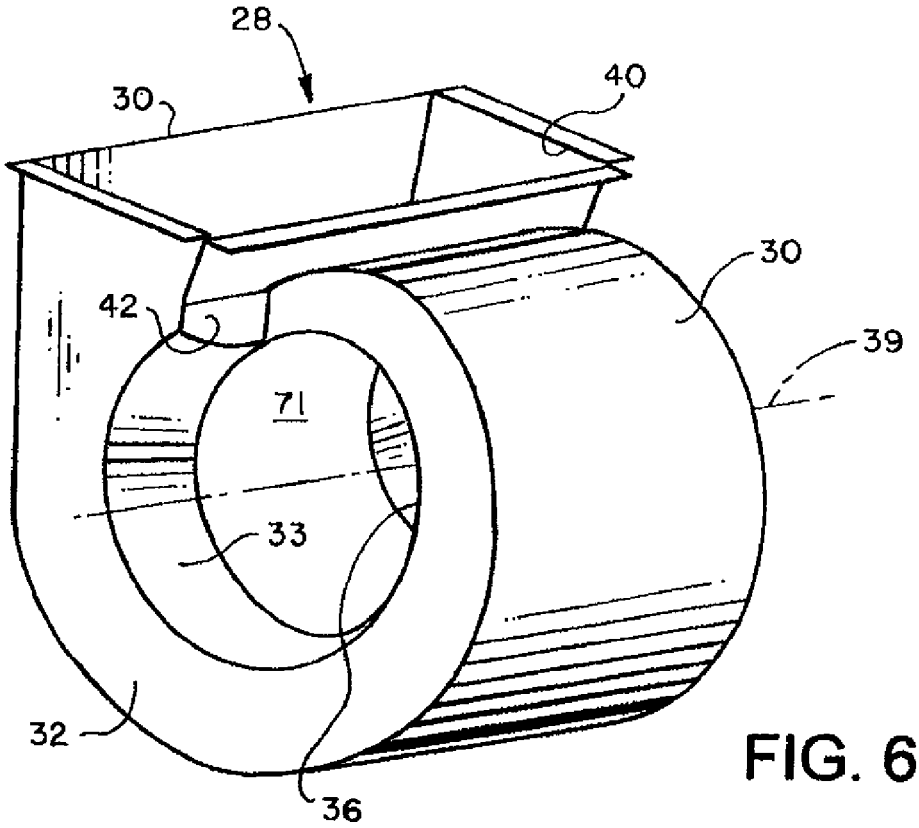
FIG. 6 is a perspective view of one side of the blower housing.
Figure 7:
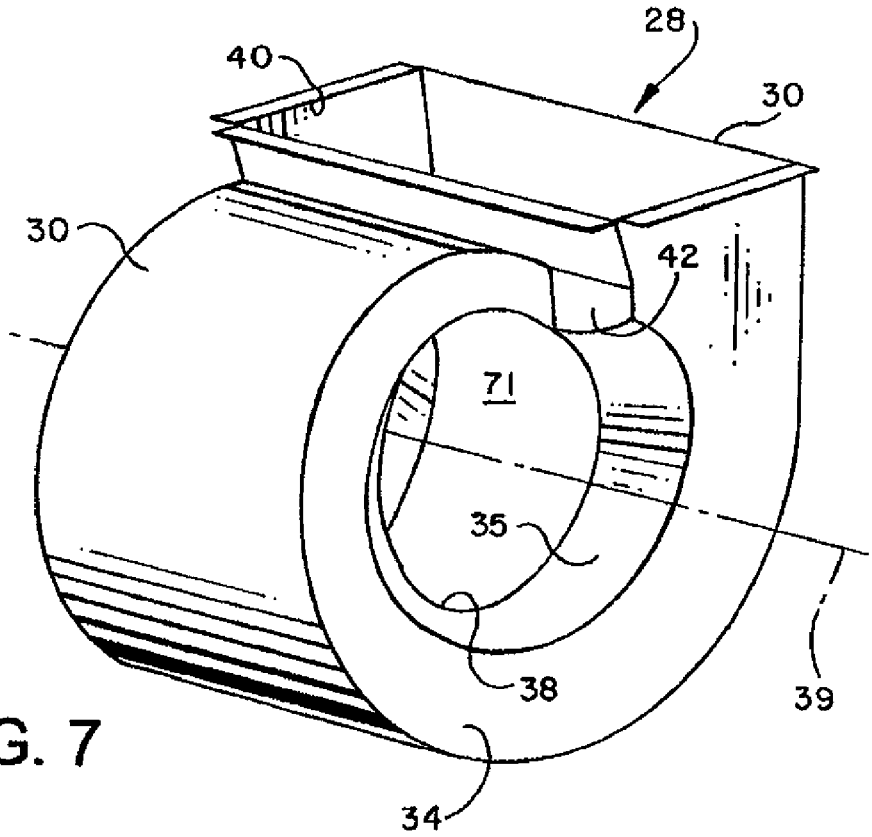
FIG. 7 is a perspective view of an opposite side of the blower housing.

Disposed within the cabinet 12 is a scroll type blower housing, generally designated by the numeral 28. As shown also in FIGS. 3, 5, 6 and 7, blower housing 28 includes a somewhat scroll or spiral shaped outer wall 30, opposed tapering sidewalls 32 and 34, see FIGS. 3, 6 and 7, and coaxial inner wall parts 33 and 35, see FIGS. 6 and 7, defining opposed air inlet openings 36 and 38. An air discharge opening 40 is defined by outer wall 30, opposed sidewalls 32 and 34 and an inner wall part 42, which is intersected by the outer wall 30 and is contiguous with the sidewalls 32 and 34, as shown in FIGS. 3, 6 and 7. Accordingly, housing 28 defines a flowpath for air being induced into the housing through openings 36 and 38 and being discharged through opening 40 wherein, preferably, a continuously increasing cross sectional area of the air flowpath is provided when viewed in circumferentially spaced radial planes extending from the central axis 39 of the openings 36 and 38. Accordingly, blower housing 28, when mounted within cabinet 12, is disposed such that its air outlet opening 40 is directly adjacent to opening 26 in cabinet topwall 24. Sidewalls 32 and 34 of housing 28 are suitably spaced from sidewalls 14 and 16 within the interior space 23 of cabinet 12 to allow unrestricted airflow from opening 20 through the interior space and into the air inlet openings 36 and 38 of housing 28.

Referring further to FIGS. 1, 2, 3 and 51 cabinet 12 is provided with an interior transverse wall 44 having a substantially vertical part 44*a*, parallel to backwall 18 and a part 44*b* which slopes toward front wall 19 of cabinet 12, as shown. Cabinet wall part 44*a* is contiguous with a part of outer wall 30, see FIG. 3, and supports a combustion gas plenum, generally designated by the numeral 50. Plenum 50 supports a motor driven combustion gas inducer pump or fan 51 including a drive motor 52, FIGS. 2 and 3, for driving a centrifugal impeller, not shown, in flow communication with the plenum 50 for discharging combustion gasses through a discharge conduit 56, FIGS. 1, 2 and 5. An elongated, generally flat plate support bracket 58, FIGS. 1 and 2, extends between and is supported by sidewalls 14 and 16, extends generally parallel to wall part 44*b* and is spaced therefrom. Plate like support bracket 58 is operable to support spaced apart combustion gas burner nozzles 60, six shown by way of example. Burner nozzles 60 are aligned with combustion fuel gas discharge nozzles 62, respectively, and which are mounted on a tubular manifold 64 connected to a conventional fuel flow and pressure regulator control valve 66, adapted to be connected to a source of fluid fuel, such as natural gas. Manifold 64 is suitably supported within the interior of cabinet 12 by opposed brackets 65 and 67, FIGS. 1 and 2. Burner nozzles 60 are also provided with suitable igniter devices, not shown in the drawing figures.

Figure 4:
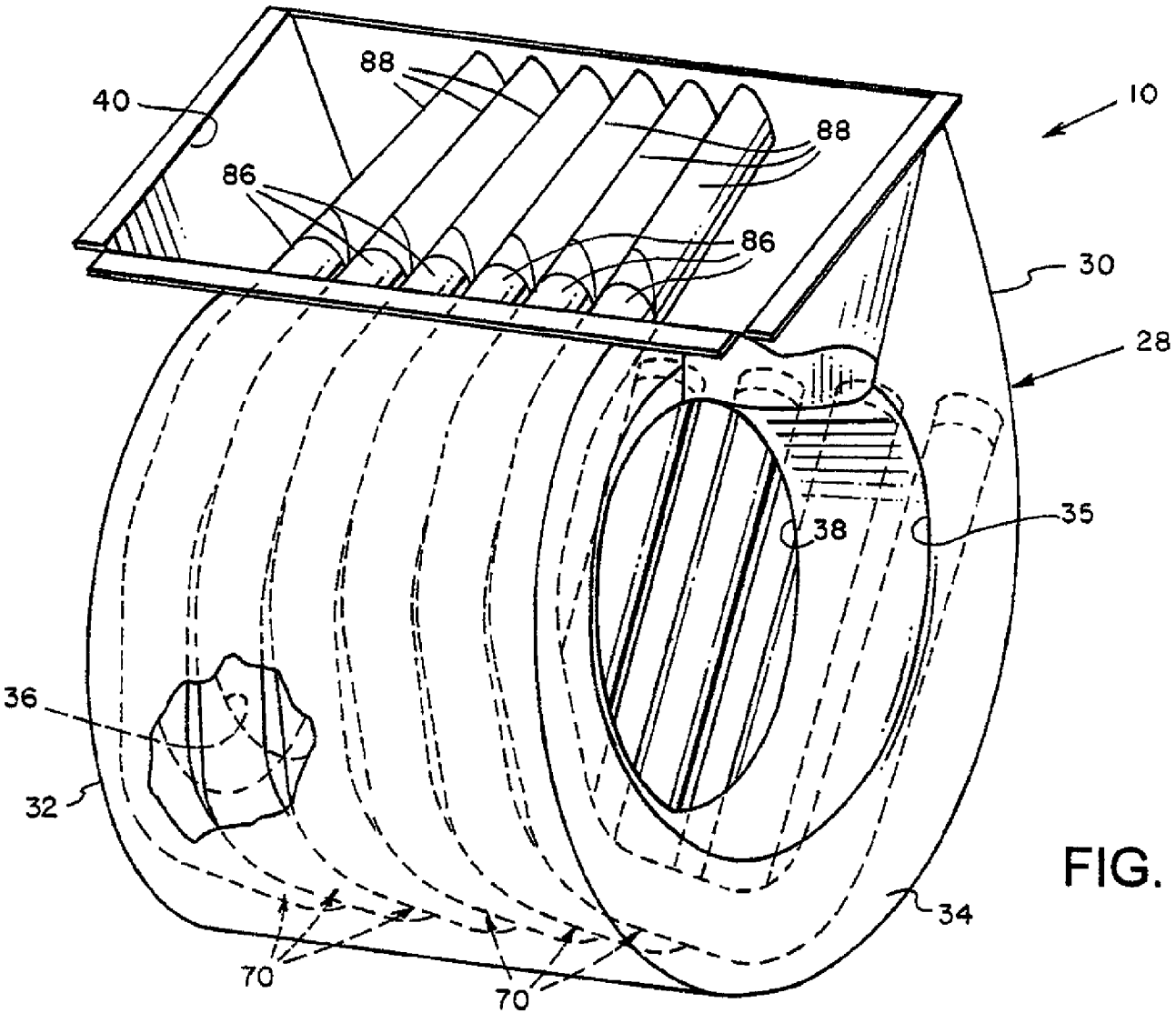
FIG. 4 is a perspective view of the integrated blower housing and heat exchanger showing the general arrangement of plural heat exchanger tubes disposed within a scroll-like combination blower and heat exchanger housing.

Wall part 44*b* is provided with plural spaced apart openings 69, FIGS. 1 and 2, aligned with each of the burner nozzles 60, respectively. Heated combustion gasses and induced air flow through the openings 69 into respective heat exchanger conduits comprising combustion gas conducting tubes 70, FIGS. 4 and 5, and combustion gas conducting tubes 90, FIG. 8, major portions of which are disposed side by side, substantially parallel to and spaced apart from each other, as shown, and within the interior space 71 of blower housing 28. As shown in FIG. 5, by way of example, each of combustion gas heat exchanger tubes 70 includes an inlet end 73 connected to wall part 44*b* and aligned with an opening 69 therein. Tubes 70 each include a substantially straight or linear section 74, preferably of cylindrical cross section geometry, extending through outer wall 30 and within space 71 to a first curved section 76 contiguous with a second linear or straight section 78 which is contiguous with additional curved sections 80, 82, 84 interconnected by linear sections 81 and 83. The cross section of each heat exchanger tube 70 between inlet end 73 and the gas discharge end of curved section 84 may be substantially cylindrical, however, the cross section shape of the straight or linear tube sections, in particular, maybe of different geometry to improve heat transfer. A generally cylindrical linear transition piece 86 is connected to a final gas discharge tube section 88 which is preferably of somewhat elliptical cross section, see FIG. 3 also, so as to minimize the projected cross sectional area exposed to airflow being discharged from blower housing 28 and to provide for communication with plenum 50. Heat exchanger tube sections 86 project through a blower cutoff wall section 43 adjacent discharge opening 40, as illustrated in FIGS. 3 and 5. The gas discharge end of each elliptical cross section tube section 88 projects through outer wall 30 at the plenum 50 for discharging combustion gasses into the plenum under the inducement of the inducer blower or fan 51 for discharge through the discharge flue pipe 56. The side-by-side, spaced apart configuration of the combustion gas heat exchanger tubes 70 is also shown in FIG. 4.

Referring again to FIG. 1 and also FIG. 5, the heater or furnace 10 includes a motor driven blower disposed within the housing 28 and characterized by a drive motor 92 mounted on circumferentially spaced brackets 94 which are connected to housing 28 in a conventional manner. Motor 92 extends at least partially within opening 38 and is drivably connected to a generally cylindrical, so-called squirrel cage type centrifugal impeller 96 of conventional construction and disposed within a portion of the interior space 71 of the housing 28 and substantially surrounded by the heat exchanger tubes 70 and 90, as shown by way of example in FIG. 5 and FIG. 8. Impeller 96 is disposed for rotation about axis 39. Another advantageous aspect of the invention is provided by the orientation of the tubes 70 and 90 which extend in a direction substantially within and parallel to the plane of rotation of impeller 96 for maximizing exposure to air flow exiting the outer circumference 96*a* of the impeller 96 and across the width thereof. Accordingly, the heat exchanger of the furnace 10, comprising the plural spaced apart heat exchanger tubes 70 or 90, is substantially integrated with the blower housing 28, and is exposed to air entering the interior space 71 of the housing 28 as induced by the blower or fan impeller 96 operating otherwise in a conventional manner. Moreover, by providing plural spaced apart heat exchanger tubes for conducting combustion gasses mixed with an induced and heated flow of air from each of the burner nozzles 60, an efficient and high rate of heat exchange may be accomplished in a relatively small space and without degrading the performance of the motor driven blower or fan 96. Still further, the configuration of the heat exchanger tubes 70 and 90 is such that, as provided by the alternating straight and curved tube sections 74, 76, 78, 80, 81, 82, 83 and 84, for example, air being discharged from the impeller 96 may flow over more than one section of a tube 70 or 90 as the flow progresses in a counterclockwise direction, viewing FIG. 5, toward opening 40, again to improve heat transfer. This improved heat transfer results, at least in part, due to the proximity of straight tube sections 74, 78, 81 and 83 to the impeller 96 and the proximity of curved tube sections 76, 80, 82 and 84 to the outer wall 30.

Figure 8:
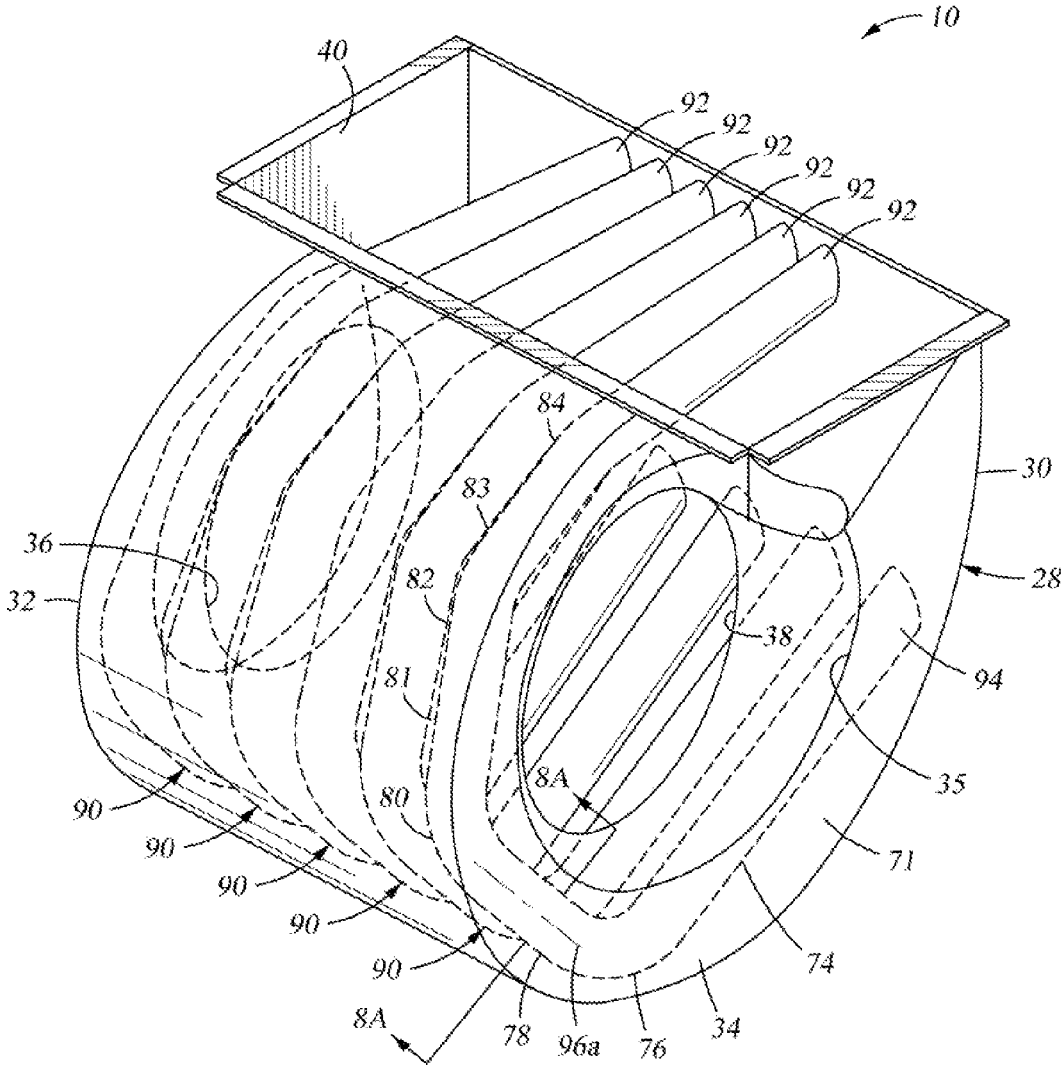
FIG. 8 is a second perspective view of the integrated blower housing and heat exchanger showing, in particular, an arrangement of plural elliptically-shaped heat exchanger tubes disposed within the scroll-like combination blower and heat exchanger housing.
Figure 8A:
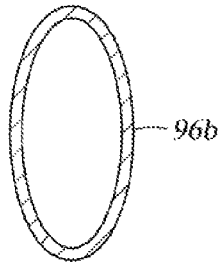
FIG. 8A is a cross-sectional end view, taken along section line 8A-8A, of one of the elliptically-shaped heat exchanger tubes disposed within the integrated blower housing and heat exchanger of FIG. 8.

FIG. 8 is a second perspective view of the integrated blower housing and heat exchanger showing, in particular, an exemplary arrangement of plural elliptically-shaped heat exchanger tubes disposed within the scroll-like combination blower and heat exchanger housing. As shown in FIG. 1 and FIG. 8, by way of example, each of combustion gas heat exchanger tubes 90 includes an inlet end 94 connected to wall part 44*b* and aligned with an opening 69 therein. Each of tubes 90 is preferably of elliptical cross section geometry and includes a substantially straight or linear section 94 extending through outer wall 30 and within space 71 to a first curved section 76 contiguous with a second linear or straight section 78 which is contiguous with additional curved sections 80, 82, 84 interconnected by linear sections 81 and 83, and a substantially straight or linear discharge end 92 that projects through outer wall 30 at the plenum 50 for discharging combustion gasses into the plenum under the inducement of the inducer blower or fan 51 for discharge through the discharge flue pipe 56. Notably, as shown by the cross sectional view taken generally along section line 8A-8A and centered about line 96*a* in exemplary section 78, the cross section 96*b* of each heat exchanger tube 90 between the inlet end 94 and the gas discharge end 92 is preferably substantially elliptical in shape, which promotes increased heat exchange efficiency. The side-by-side, spaced apart configuration of the combustion gas heat exchanger tubes 90 is also shown in FIG. 8.

The construction and operation of the heater or furnace 10 is believed to be within the purview of one skilled in the art based on the foregoing description. Conventional engineering materials used for furnace components, including blowers and heat exchangers and known to those skilled in the art, may be used to construct the furnace 10.

Although a preferred embodiment of the invention has been described in detail herein, those skilled in the art will recognize that various substitutions and modifications may be made without departing from the scope and spirit of the appended claims.

What is claimed is:

1. A heater for circulating heated air to an enclosed space, said heater comprising:

a blower housing including an outer wall and opposed sidewalls;

a rotatable impeller disposed within said blower housing for circulating air through said blower housing from at least one air inlet opening along an airflow path to at least one air discharge opening in said blower housing; and plural heat exchange conduits for carrying combustion gasses each comprising a first tube section for receiving the combustion gasses and a gas discharge tube section for discharging the combustion gasses, said plural heat exchange conduits disposed within said blower housing and disposed around at least a portion of the periphery of said impeller for heating air circulated by said impeller within said blower housing, wherein at least one heat exchange conduit of the plural heat exchange conduits comprises a heat exchange tube having a generally elliptical cross section;

wherein at least one of the gas discharge tube sections is disposed substantially adjacent to the at least one air discharge opening in said blower housing and is located downstream along said airflow path relative to at least one of the first tube sections.

2. The heater set forth in claim 1 including:

a motor mounted on said blower housing and drivingly connected to said impeller.

3. The heater set forth in claim 2 wherein:

said blower housing includes opposed air inlet openings formed in respective ones of said sidewalls.

4. The heater set forth in claim 3 wherein:

said sidewalls are tapered axially with respect to an axis of rotation of said impeller and at least partially around said periphery of said impeller.

5. The heater set forth in claim 4 wherein:

said impeller comprises a centrifugal impeller directly connected to said motor.

6. The heater set forth in claim 1 wherein:

said heat exchange conduits comprise plural heat exchange tubes having respective inlet ends for receiving heated combustion gasses from respective burner nozzles.

7. The heater set forth in claim 6 wherein:

said heat exchange tubes include gas inlet ends projecting through said outer wall of said blower housing, respectively.

8. The heater set forth in claim 6 wherein:

said burner nozzles are arranged side by side adjacent a fuel manifold for receiving combustion fluid fuel for combustion in said burner nozzles whereby combustion gasses generated in said burner nozzles are transported through said heat exchange tubes.

9. The heater set forth in claim 6 wherein:

said heat exchange tubes have plural sections disposed such that said air circulating within said blower housing contacts successive ones of said sections during flow from said impeller to said at least one discharge opening.

10. The heater set forth in claim 9 wherein:

selected ones of said sections are disposed closer to said impeller than others of said sections.

11. The heater set forth in claim 6 wherein:

said heat exchange tubes include respective discharge ends opening into a plenum of said heater for discharging combustion gasses thereto.

12. The heater set forth in claim 11 including:

a combustion gas flow inducing blower operably connected to said plenum for inducing flow of combustion gasses through said heat exchange tubes and for discharge to a flue conduit.

13. The heater set forth in claim 6 including:

a cabinet supporting said blower housing including a first wall having an opening in communication with said at least one discharge opening in said blower housing, and spaced apart sidewalls connected to said first wall and forming a space for directing airflow to said at least one inlet opening in said blower housing.

14. The heater set forth in claim 13 including:

a support wall part including plural openings formed therein aligned with gas inlet ends of said heat exchange tubes and for receiving combustion gasses from respective ones of said burner nozzles.

15. The heater set forth in claim 6 wherein:

said heat exchange tubes each include a first section directly in communication with one of said burner nozzles, said first section being substantially linear, plural curved sections configured for orienting said heat exchanger tube about the periphery of said impeller and a discharge section in communication with a plenum.

16. The heater set forth in claim 1 wherein:

each heat exchange conduit of the plural heat exchange conduits comprises a heat exchange tube having a generally elliptical cross section.

17. A heater for circulating heated air to an enclosed space, said heater comprising:

a blower housing including an outer wall and opposed sidewalls;

a centrifugal impeller disposed within said blower housing for circulating air through said blower housing from at least one air inlet opening along an airflow path to at least one air discharge opening in said blower housing;

a motor mounted on said blower housing and drivingly connected to said impeller; and plural side-by-side heat exchange tubes disposed within said blower housing and disposed around at least a major portion of the periphery of said impeller for carrying combustion gasses and for heating air circulated by said impeller within said blower housing, each heat exchange tube comprising a first tube section for receiving the combustion gasses and a gas discharge tube section for discharging the combustion gasses, wherein at least one heat exchange tube of the plural heat exchange tubes has a generally elliptical cross section;

wherein at least one of the gas discharge tube sections is disposed substantially adjacent to said at least one air discharge opening in said blower housing and is located downstream along said airflow path relative to at least one of the first tube sections.

18. The heater set forth in claim 17 including:

plural burner nozzles arranged side by side adjacent a fuel manifold for receiving combustion fluid fuel for combustion in said burner nozzles whereby combustion gasses generated in said burner nozzles are transported through said heat exchange tubes.

19. The heater set forth in claim 18 wherein:

said heat exchange tubes include respective discharge ends opening into a plenum of said heater for discharging combustion gasses thereto.

20. The heater set forth in claim 18 wherein:

said first tube sections are directly in communication with said burner nozzles, said first tube sections being substantially linear, plural curved sections configured for orienting said heat exchanger tube about the periphery of said impeller and wherein said gas discharge tube sections are in communication with a plenum.

21. The heater set forth in claim 20 wherein:

each of said heat exchange tubes has a generally elliptical cross section.

22. The heater set forth in claim 17 including:

a cabinet supporting said blower housing including a first wall having an opening in communication with said at least one discharge opening in said blower housing, and spaced apart sidewalls connected to said first wall and forming a space for directing airflow to said at least one inlet opening in said blower housing.

23. The heater set forth in claim 17 wherein:

said heat exchange tubes have plural sections disposed such that said air circulating within said blower housing contacts successive ones of said sections during flow from said impeller to said at least one discharge opening.

24. The heater set forth in claim 23 wherein:

selected ones of said sections are disposed closer to said impeller than others of said sections.

* * * * *